US006719471B1

(12) United States Patent
Giro

(10) Patent No.: US 6,719,471 B1
(45) Date of Patent: Apr. 13, 2004

(54) TOOTHBRUSH INCORPORATING A TOOTHPASTE RESERVOIR

(75) Inventor: Domingo Obradors Giro, Barcelona (ES)

(73) Assignee: Instituto de Higiene Y Servicios Dentales, S.A., Barcelona (ES)

( * ) Notice: Subject to any disclaimer, the term of this patent is extended or adjusted under 35 U.S.C. 154(b) by 0 days.

(21) Appl. No.: 10/385,176

(22) Filed: Mar. 10, 2003

(51) Int. Cl.[7] ..... A46B 11/02
(52) U.S. Cl. ..... 401/188 R; 401/187; 401/270
(58) Field of Search ..... 401/188 R, 187, 401/270, 278, 279

(56) References Cited

U.S. PATENT DOCUMENTS 3,400,996 A * 9/1968 Vandergrift ..... 401/184
5,393,153 A * 2/1995 Bouthillier et al. ..... 401/146
6,039,489 A * 3/2000 Harman et al. ..... 401/146
6,050,736 A * 4/2000 Gonzalez ..... 401/281

* cited by examiner

*Primary Examiner*—David J. Walczak
(74) *Attorney, Agent, or Firm*—Steinberg & Raskin, P.C.

(57) ABSTRACT

A toothbrush incorporating a toothpaste reservoir including a hollow body defining a head member having bristles, the hollow body forming a handle, a toothpaste containing reservoir housed in the handle and a pump arranged in the body to impel toothpaste towards the bristles. The pump is actuated by an outer push slidably mounted on the handle in engagement with the body of the pump. The handle defines an open bottom at a rear end allowing positioning and replacement of the toothpaste reservoir. The reservoir has an open top capped by an open cap extending in form of a cannula towards an inside of the reservoir. A bottom cap caps the open bottom of the handle. Sliding movement of the push toward the head member and relative to the handle causes toothpaste in the reservoir to be drawn out of the reservoir by the pump and directed toward the head member.

20 Claims, 3 Drawing Sheets

E'
38
28'
34'
6
15
G
37
35'
29''
31'

35'
34'
28'
31'
35'

B'
27'
27''
15
33''
33'
28'
35''

27'
27''
28'
35''

E
27
34
6
33
15
B
32
28
35
29
30
31
36

27
29
35
30
28
34
31
36

TOOTHBRUSH INCORPORATING A TOOTHPASTE RESERVOIR

FIELD OF THE INVENTION

This invention relates to a toothbrush of the type of those including in their handle a toothpaste reservoir and a pump which when being manually actuated impels the toothpaste from the reservoir towards outlets being defined in the head member being provided with brush bristles.

BACKGROUND OF THE INVENTION

Several toothbrush models are known at present which include a toothpaste reservoir being generally arranged in the hollow handle of the toothbrush, and means being provided for dispensing said toothpaste through orifices being defined in the head member being provided with the brush bristles.

In one of these toothbrushes the very hollow handle serves as the toothpaste reservoir, said toothpaste being impelled towards the head member by means of a pusher device being provided on the handle.

In other toothbrushes the hollow handle is semirigid and comprises in its inside a reservoir which when being pressed expels the toothpaste towards the head member.

Other toothbrushes comprise a head member carrying piece and a toothpaste reservoir housed in the handle, and between them a pump is arranged which when being actuated impels the toothpaste.

In the known toothbrushes of the above-mentioned type a cannula is attached to the rear nipple of the pump, the toothpaste reservoir being apt to at its open top be fitted to the rear portion of the pump, the cannula being thus housed inside the reservoir.

When in these toothbrushes the reservoir has run out of toothpaste said reservoir is removed in order to insert a new reservoir with a refill of toothpaste into the handle of the toothbrush. Due to the presence of toothpaste remains in the cannula this operation turns out to be annoying for the user since the toothpaste remains drip therefrom and thus soil the user's hands and the place having been chosen to carry out the replacement of the reservoir.

This latter is the toothbrush type being improved by the present invention

BRIEF SUMMARY OF THE INVENTION

The toothbrush being the object of the invention is of the type comprising an outer body and a top cap, said outer body defining a head member with the bristles fixed on it, and a rear hollow portion by way of handle housing a toothpaste reservoir and a pump being provided to impel the toothpaste towards the base of the bristles, said toothbrush having a number of design peculiarities whose purpose is to facilitate the actuation of the pump in order to obtain an additional toothpaste delivery with no need for the user to stop the teeth brushing operation, which is what must be done in the case of the known toothbrushes.

One of the main characteristics of this invention consists in the fact that the pump actuating means are formed by an outer push being slidably mounted on the toothbrush portion forming the handle.

Said push has means being provided to allow to slidably mount it on an opening defined in the very handle of the toothbrush, and means being provided to allow it to engage the pump body, in such a way that when sliding the push the pump is actuated and a certain quantity of toothpaste is thus impelled towards the base of the bristles.

The incorporation of this push and its arrangement in the forward region of the handle allow the user to actuate it with one finger to thus obtain an additional quantity of toothpaste while he or she is using the toothbrush.

At the rear lateral sides this push is provided with two legs extending from a backwardly located appendage of said push and together with said appendage forming a U-shaped cavity being engageable with the open section of a piece being fitted on the pump.

The main body of the toothbrush comprises an intermediary length having an initial, straight portion whose cross-section is sensibly smaller than that of the handle thus allowing to fit the top cap to said initial, straight portion, and a final portion taperingly decreasing its cross-section towards the head member.

The portion of the toothbrush forming the handle is of sufficient length to house in its inside a toothpaste reservoir being provided to be pressure fitted to the backward region of the pump.

The replaceable reservoir or refill for this kind of toothbrush obviates the above-mentioned drawbacks.

In order to achieve said improvements the cannula being directly fitted to the pump has been eliminated, and the present refill has been devised in such a way that it does already incorporate the cannula, this latter forming part of an open cap capping the open top of the reservoir, said original open cap having been tightly sealed at the originating site thus guaranteeing that the contained toothpaste is the original one.

Said open cap is fitted to the open top of the reservoir by means of a peripheral tongue jointing arrangement, the rear nipple of the pump being fitted in a sealing arrangement into said open cap, the toothpaste being sucked up through said rear nipple, said open cap having been provided with an orifice in order to thus facilitate the ingress of air into the reservoir.

It has also been foreseen in this toothbrush that when having run out of toothpaste the toothpaste containing reservoir can be refilled from a toothpaste supplying container, the toothbrush being for such a purpose provided with an accessory allowing to carry out said refilling operation by means of fitting an end of said accessory to the container and the opposite end of said accessory to the reservoir.

This accessory is formed by a bushing having an outer periphery end being apt to be fitted to the open tops of said reservoir and of the open cap with cannula capping it, said bushing also having a flange being apt to be abuttingly applied against said open tops.

There are two versions of said accessory, one of them allowing to fit said accessory to a conventional container and in this case axially comprising in its opening being provided to face said container a tubular projection being apt to be connected to the nipple of the container; whereas the other one is apt to be fitted to a specific container and has an abutting flange being formed by a skirt ending in a peripheral fastening catch allowing to securely fit the accessory to the neck of the container.

Another of the improvements being envisaged for the enhancement of said toothbrush consists in providing the bottom cap with a pocket being apt to accommodate a dental floss spool, the bottom of said cap being apt to be opened to thus facilitate the access to said dental floss and its replacement.

It has also been foreseen in this toothbrush to carry out a vacuum suction of the toothpaste being contained in the reservoir (airless operation), this being achieved either by having the toothpaste contained in a flexible bag being introduced in the reservoir or by arranging a piston at the bottom of said reservoir.

These and other characteristics will be best made apparent by the following detailed description whose understanding will be made easier by the accompanying three sheets of drawings showing practical embodiments being cited only by way of example not limiting the scope of the present invention.

DETAILED DESCRIPTION OF PREFERRED EMBODIMENTS

Figure 1:
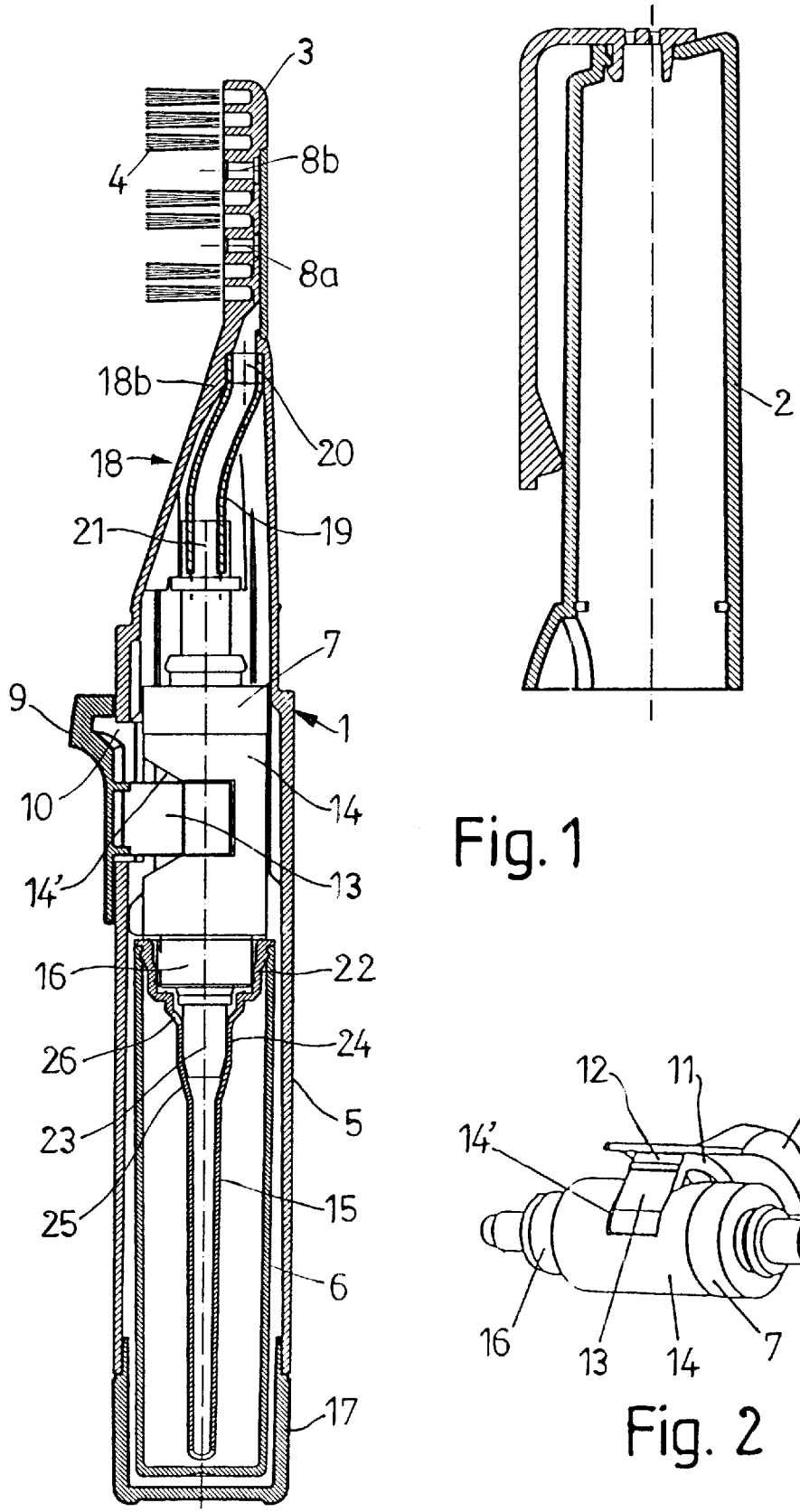
FIG. 1 shows in a separated arrangement a side elevation of the toothbrush in accordance with the invention with its top cap having been sectioned along a longitudinal plane with the exception of the pump.

As can be seen in the above-mentioned figures the toothbrush being the object of the invention comprises a body 1 and a top cap 2 being provided to be fitted to it.

Said body 1 defines a head member 3 being provided with bristles 4 having been fixed to it, and a handle 5 housing a toothpaste containing reservoir 6 and a pump 7 which when being manually actuated impels the toothpaste from the reservoir 6 towards orifices 8*a* and 8*b* being defined in head member 3 and in correspondence with the base of said bristles 4.

According to the invention the means being provided to actuate the pump 7 are formed by a push 9 being fitted in a longitudinally slidable arrangement to an opening 10 having been provided in a forwardly located region of the lateral side of the handle 5.

Figure 2:
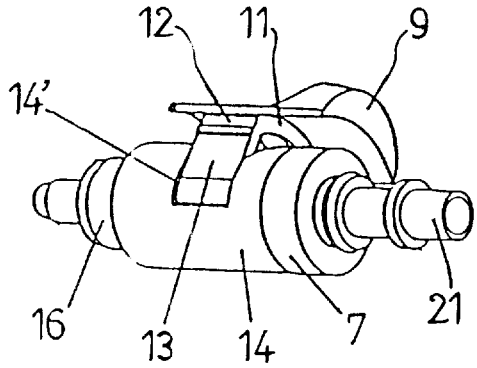
FIG. 2 shows a perspective view of the push being fitted to the pump.

The push 9 has on its inner surface an appendage 11 being provided with lateral guides 12 and legs 13, these latter together with said appendage defining a sensibly U-shaped cavity (FIG. 2).

Said guides 12 have been provided for the purpose of being inserted into the handle 5 through the opening 10 to thus engage each of the material portions corresponding to the two opposite sides of said opening 10, the push 9 being in this way in a position to be longitudinally slid on said opening.

The legs 13 have been provided for the purpose of engaging the body of the pump 7 and fitting into an open section 14' of a piece 14 being fitted on the pump 7 in order to have this latter actuated when sliding the push 9; this arrangement in this way assuring that each time the push 9 is actuated by means of sliding it towards the forward region of the toothbrush the pump 7 will be actuated, and this latter will hence impel a given quantity of toothpaste from the inside of the reservoir 6 towards the outlets 8*a* and 8*b* of the head member.

Both the handle 5 and the reservoir 6 can have a circular or oval, cylindrical configuration.

The reservoir 6 is replaceable and has in its inside a cannula 15 being provided to be fitted to the open top of the reservoir 6, this assembly being fitted to the backward region 16 of the pump 7 and being shifted together with this latter when push 9 is actuated.

The reservoir 6 has a cross-section that is smaller than that of handle 5, and is only in contact with the pump 7 and the inner surface of the bottom cap 17 of the handle, said reservoir being guided on said inner surface.

Between the head member 3 and the handle 5 the body 1 of the toothbrush has an intermediary, hollow length 18 housing a flexible tube 19 being provided with an open end 20 for the passage of the toothpaste from the reservoir 6.

The tube 19 has been provided for the sole purpose of allowing the toothpaste to pass from the front end 21 of the pump to the orifices 8*a* and 8*b*, and is fitted at one of its ends to said end 21 of the pump and at its other end to the inner, narrowest portion 18*b* of the intermediary length 18 taperingly decreasing its cross-section towards the head member.

The top cap 2 is apt to be pressure fitted onto this length 18.

It is to be pointed out that orifices 8*a* and 8*b* for the egress of toothpaste are of different diameters, the bigger diameter corresponding to the one being closest to the front end of the toothbrush; this diameter difference allowing to obtain practically the same quantity of toothpaste exiting through each of them when the pump is actuated.

The replaceable refill for the toothbrush comprises the cylindrical reservoir 6 whose open top is capped by means of an open cap 22 extending in form of the cannula 15 towards the inside of said reservoir up to the proximity of its bottom thus forming an assembly being housed in the hollow toothbrush handle 5 also housing the pump 7 which when being actuated will deliver the toothpaste thus feeding the bristled head member of the toothbrush with it, open cap 22 being fitted in a sealing arrangement to the pump's rear portion 16 being provided with the nipple 23 through which the toothpaste will be sucked up.

At the originating site this refill will be tightly sealed by means of a discoidal sealing element being fixed on the open top of the open cap 22, said sealing element having to be removed before incorporating the refill into the toothbrush.

Open cap 22 is fitted to the open top of the reservoir 6 by means of a peripheral tongue jointing arrangement.

Said open cap 22 has cylindrical sections and tapered sections whose diameter decreases towards the cannula 15. The rear portion 16 of the pump fits into the cylindrical open top of the open cap 22, and the rear nipple 23 of said pump fits into a cylindrical portion 24 whose diameter is smaller than that of the open cap and which is followed by a tapered length 25 matching with the end tapering of said nipple 23. This fitting of the open cap with cannula 22-15 to the rear portion 16 of pump 7 is a sealingly tight fitting because of the nature of the semirigid plastics material out of which this refill is made.

An intermediary portion of the open cap 22 has been provided with an orifice 26 to facilitate the ingress of air into the reservoir 6 to thus balance the pressure when the toothpaste is sucked up by the pump.

It has been foreseen to provide the toothbrush being the object of the instant invention with an accessory allowing to refill the toothpaste reservoir 6 and thus obviating the need to replace it when it has been emptied; this allowing to always have the toothbrush provided with the corresponding toothpaste fill and also entailing a financial benefit.

Figures 3, 4, 5, 6, 7, 8:
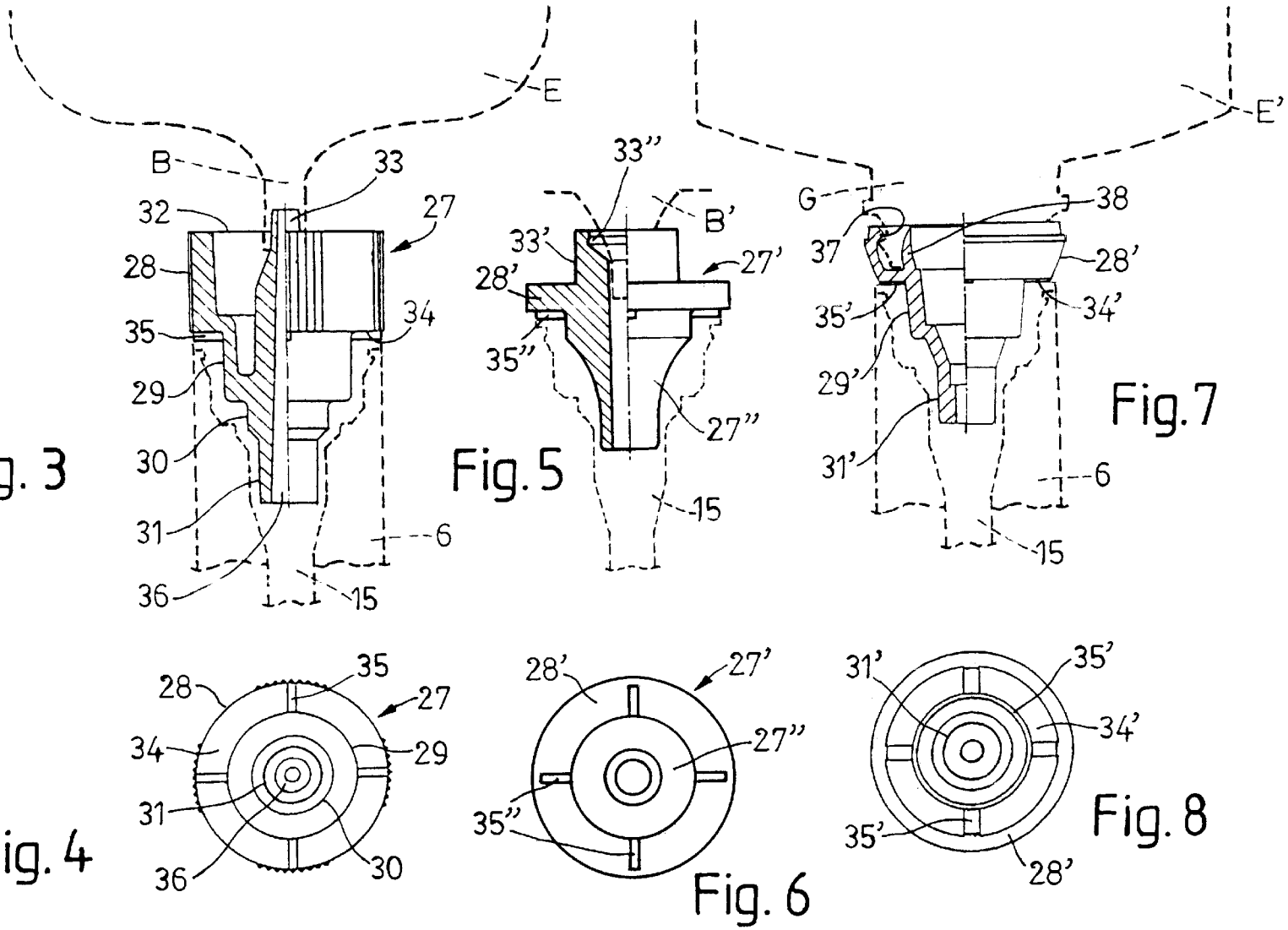
FIGS. 3 and 4 respectively represent in an elevational half section and in a plan-view the accessory being apt to be used to refill the reservoir from conventional containers.
FIGS. 5 and 6 respectively correspond to the elevational half section and the plan-view of the accessory being apt to be used to refill the reservoir from conventional containers, said accessory having in this case been made as per a resilient embodiment.
FIGS. 7 and 8 respectively correspond to the elevational half section and the plan-view of the accessory being apt to be used to refill the reservoir from a specific container.

Said refilling accessory is as per FIGS. 3 and 4 made up of a bushing 27 having at its outer periphery four different diameters 28, 29, 30 and 31 of decreasing dimensions in this same order to thus be apt to be fitted to the open tops of the reservoir 6 and of the open cap with cannula 15 capping it. At its end opening 32 of a bigger diameter this bushing is axially provided with an axially arranged, tubular projection 33 allowing to connect it to the nipple B of the conventional container E supplying the toothpaste. The periphery 28 makes up a flange, shoulder 34 forming a butt having radial ribs 35 being apt to facilitate the passage of air when this device 27 is fitted to the open top of the open cap with cannula 15. The axial passage 36 of said accessory taperingly increases its size towards the accessory end having the smallest diameter.

FIGS. 5 and 6 represent a different embodiment of the accessory of FIGS. 3 and 4, said accessory being in this case of a resilient nature in order to thus be apt to be connected to a nipple B' of a conventional container, said nipple possibly having different shapes and diameters. The bushing 27' has in this case its outer periphery having a generally frustoconical shape 27" in order to thus be apt to fit into the open top of the open cap with cannula 15 to which it is meant to be connected, said bushing comprising a flange 28' being apt to abuttingly engage said open top, said bushing also at its opening being opposite to said connection to said open top of said open cap with cannula being axially provided with a tubular projection 33' ending in a taperingly widened opening 33". Said flange 28' is also provided with the radial ribs 35".

FIGS. 7 and 8 represent the refilling accessory being apt to be connected to a specific container, said accessory having besides the outer periphery with different diameters 31', 29' and 28' also means allowing to fasten it to the neck G of the corresponding container E', said means being made up of the periphery 28' forming a skirt ending in a peripheral catch 37 and of an innerly and coaxially arranged peripheral lip 38. The abutting shoulder 34' is also provided with radial ribs 35'.

Figure 9:
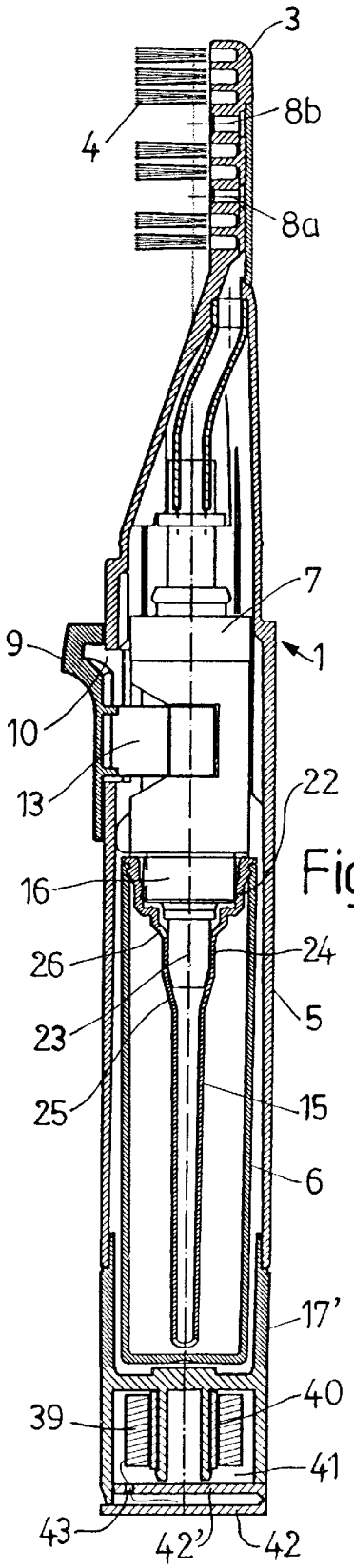
FIG. 9 is a sectional elevation of the toothbrush being equipped with the dental floss.

Also characteristic of this toothbrush is the fact of its being equipped with dental floss thus facilitating a more efficient cleaning of the teeth. This characteristic can be appreciated in FIG. 9, this latter showing the dental floss 39 being wound on a spool 40 being housed in a pocket 41 at the rear portion of cap 17', this latter's bottom 42 being apt to be opened to thus facilitate the access to the dental floss as well as its replacement upon having been used up. The cap has in the illustrated embodiment a double bottom 42, the innermost portion 42' having been provided with an orifice 43 being apt to let the dental floss out therethrough.

Figure 10:
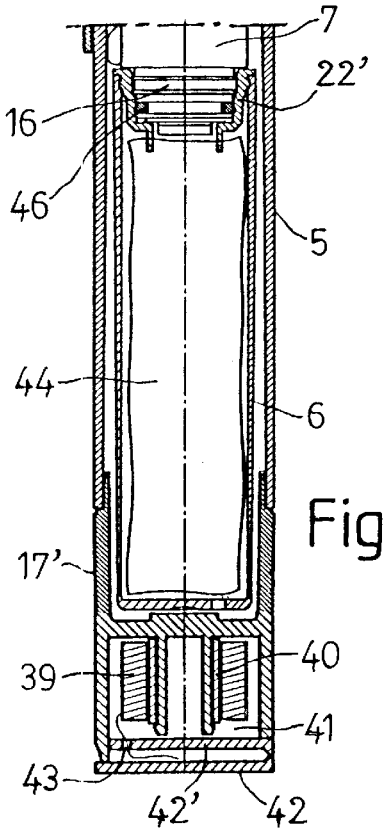
FIGS. 10 and 11 are respective sectional views of the toothbrush handle in its version carrying out a vacuum suction of the toothpaste and respectively using a flexible bag or else a piston being housed in the containing reservoir.
Figure 11:
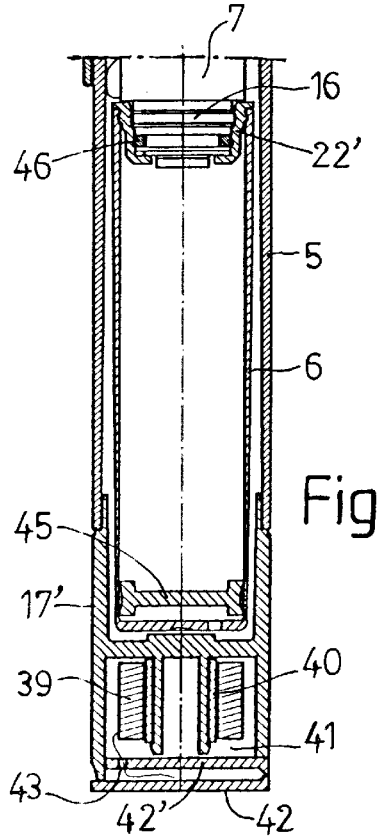

The pump 7 being provided in connection with this toothbrush will be a vacuum sucking pump (airless operation), the toothpaste containing reservoir 6 for such a purpose not having the cannula 15 and in its stead having a flexible bag 44 containing the toothpaste (FIG. 10), or else having at its bottom a piston 45 (FIG. 11). In these cases the reservoir is capped with cap 22' being apt to fittingly admit the backward region 16 of pump 7 by means of a seal 46.

The above explanation will allow all those skilled in the art to appreciate the scope of the invention and the advantages deriving from it without having to further elaborate upon this description.

The terms having been used for this description should always be construed in their amplest, nonlimiting sense.

Other materials, shapes, sizes and arrangements can be used for the elements provided that said variations do not alter the essential characteristics of the invention as set forth in the appended claims.

What is claimed is:

1. A toothbrush incorporating a toothpaste reservoir, comprising:

a hollow body defining a head member having bristles, said hollow body forming a handle;

a toothpaste reservoir housed in said handle, said handle defining an open bottom at a rear end allowing positioning and replacement of said toothpaste reservoir, said toothpaste reservoir having an open top capped by an open cap extending in form of a cannula towards an inside of said toothpaste reservoir;

a pump arranged in said body to impel said toothpaste towards said bristles;

an outer push slidably mounted on said handle, said push having engaging means for engaging said pump to actuate said pump, said push and said pump being arranged such that sliding movement of said push toward said head member and relative to said handle causes toothpaste in said toothpaste reservoir to be drawn out of said toothpaste reservoir by said pump and directed toward said head member; and a bottom cap arranged to cap said open bottom of said handle.

2. A toothbrush as claimed in claim 1, wherein said open cap has cylindrical and tapered sections having a diameter which decreases towards said cannula, said sections snugly fitting around a rear portion of said pump and a nipple being arranged in a rear region of said pump, said open cap comprising an orifice for ingress of air into said toothpaste reservoir arranged proximate said rear region of said pump.

3. A toothbrush as claimed in claim 1, wherein said bottom cap is arranged around a bottom of said toothpaste reservoir and is structured and arranged to accommodate a dental floss spool, a bottom of said bottom cap being openable to facilitate access to said dental floss and replacement thereof.

4. A toothbrush as claimed in claim 1, wherein said engaging means comprise an appendage and two legs extending from lateral sides of said appendage to form a U-shaped cavity with said appendage, said legs fitting into an open section of a piece arranged on said pump.

5. A toothbrush as claimed in claim 1, wherein said handle includes an opening on a lateral side, said push being slidable in said opening relative to said handle.

6. A toothbrush as claimed in claim 1, further comprising a tube extending between said pump and a base of said bristles, said pump being arranged to impel said toothpaste towards the base of said bristles.

7. A toothbrush incorporating a refillable toothpaste reservoir, comprising:

a hollow body defining a head member having bristles, said hollow body forming a handle;

a toothpaste reservoir housed in said handle, said handle defining an open bottom at a rear end allowing positioning and replacement of said toothpaste reservoir, said toothpaste reservoir having an open top capped by an open cap extending in form of a cannula towards an inside of said toothpaste reservoir;

a pump arranged in said body to impel said toothpaste towards said bristles;

an outer push slidably mounted on said handle, said push having engaging means for engaging said pump to actuate said pump, said push and said pump being arranged such that sliding movement of said push toward said head member and relative to said handle causes toothpaste in said toothpaste reservoir to be drawn out of said toothpaste reservoir by said pump and directed toward said head member;

a bottom cap arranged to cap said open bottom of said handle; and an accessory arrange to couple said toothpaste reservoir to a toothpaste supply container to enable refilling of said toothpaste reservoir.

8. A toothbrush as claimed in claim 7, wherein said accessory comprises a bushing having an outer periphery end arranged to be coupled to said open cap of said toothpaste reservoir.

9. A toothbrush as claimed in claim 8, wherein said bushing also includes a flange arranged to abut against said open top of said toothpaste reservoir.

10. A toothbrush as claimed in claim 9, wherein said bushing also includes a tubular projection at an axial end opposite said flange, said tubular projection being adapted to mate with the toothpaste supply container.

11. A toothbrush as claimed in claim 9, wherein said flange includes a skirt ending in a peripheral catch enabling fastening of said accessory to a neck of the toothpaste supply container.

12. A toothbrush as claimed in claim 11, wherein said accessory also includes a peripheral lip arranged inwardly of said peripheral catch and coaxially to said peripheral catch.

13. A toothbrush as claimed in claim 7, wherein said open cap has cylindrical and tapered sections having a diameter which decreases towards said cannula, said sections snugly fitting around a rear portion of said pump and a nipple being arranged in a rear region of said pump, said open cap comprising an orifice for ingress of air into said toothpaste reservoir arranged proximate said rear region of said pump.

14. A toothbrush as claimed in claim 7, wherein said bottom cap is arranged around a bottom of said toothpaste reservoir and is structured and arranged to accommodate a dental floss spool, a bottom of said bottom cap being openable to facilitate access to said dental floss and replacement thereof.

15. A toothbrush as claimed in claim 7, wherein said engaging means comprise an appendage and two legs extending from lateral sides of said appendage to form a U-shaped cavity with said appendage, said legs fitting into an open section of a piece arranged on said pump.

16. A toothbrush as claimed in claim 7, wherein said handle includes an opening on a lateral side, said push being slidable in said opening relative to said handle.

17. A toothbrush as claimed in claim 7, further comprising a tube extending between said pump and a base of said bristles, said pump being arranged to impel said toothpaste towards the base of said bristles.

18. A toothbrush incorporating a refillable toothpaste reservoir, comprising:

a hollow body defining a head member having bristles, said hollow body forming a handle;

a toothpaste reservoir housed in said handle, said handle defining an open bottom at a rear end allowing positioning and replacement of said toothpaste reservoir, said toothpaste reservoir having an open top capped by a cap;

a pump arranged in said body to impel said toothpaste towards said bristles, said pump being arranged to carry out vacuum suction of toothpaste from said toothpaste reservoir;

an outer push slidably mounted on said handle, said push having engaging means for engaging said pump to actuate said pump, said push and said pump being arranged such that sliding movement of said push toward said head member and relative to said handle causes toothpaste in said toothpaste reservoir to be drawn out of said toothpaste reservoir by said pump and directed toward said head member; and a bottom cap arranged to cap said open bottom of said handle.

19. A toothbrush as claimed in claim 18, wherein said toothpaste reservoir comprises a flexible bag containing toothpaste, said toothpaste being sucked up from said bag by said pump.

20. A toothbrush as claimed in claim 18, wherein said toothpaste reservoir comprises a piston arranged at a bottom of said toothpaste reservoir and which is arranged to move the toothpaste by virtue of suction being carried out by said pump.

* * * * *